US011365029B2

(12) United States Patent
Kirchner

(10) Patent No.: US 11,365,029 B2
(45) Date of Patent: Jun. 21, 2022

(54) STOPPER FOR A CONTAINER

(71) Applicant: KISICO Kirchner, Simon & Co. GmbH, Oestrich-Winkel (DE)

(72) Inventor: Jan Kirchner, Oestrich-Winkel (DE)

(73) Assignee: KISICO KIRCHNER, SIMON & CO. GMBH, Oestrich-Winkel (DE)

( * ) Notice: Subject to any disclaimer, the term of this patent is extended or adjusted under 35 U.S.C. 154(b) by 21 days.

(21) Appl. No.: 17/105,829

(22) Filed: Nov. 27, 2020

(65) Prior Publication Data

US 2021/0163185 A1 Jun. 3, 2021

(30) Foreign Application Priority Data

Nov. 29, 2019 (EP) ..... 19212483

(51) Int. Cl.
*B65D 39/00* (2006.01)

(52) U.S. Cl.
CPC ..... *B65D 39/007* (2013.01); *B65D 2539/005* (2013.01)

(58) Field of Classification Search
CPC . B65D 39/007; B65D 2539/005; B65D 39/12
(Continued)

(56) References Cited

U.S. PATENT DOCUMENTS 697,798 A * 4/1902 Brooks ..... B65D 49/00 215/358
905,652 A * 12/1908 Comings ..... B65D 39/12 215/358

(Continued)

FOREIGN PATENT DOCUMENTS

EP 1286776 A1 3/2003
EP 3333096 A1 6/2018

(Continued)

OTHER PUBLICATIONS

Europäisches Patentamt (European Patent Office), Europäisches Recherchenbericht (European Search Report), dated Apr. 23, 2020 (dated Apr. 23, 2020), 7 pages, Europaisches Patentamt, München, Germany (DE).

(Continued)

*Primary Examiner* — J. Gregory Pickett
*Assistant Examiner* — Niki M Eloshway
(74) *Attorney, Agent, or Firm* — Christopher C. Dremann, P.C.; Christopher C. Dremann

(57) ABSTRACT

A stopper for a container has a jacket portion insertable into the container, wherein the jacket portion has a through-opening formed in an axial direction, wherein the stopper has at least two segments, wherein the respective segment has a free end, wherein a first portion of the free end of the respective segment forms a subregion of the jacket portion, and a second portion of the free end of the respective segment protrudes radially inward in relation to the jacket portion, wherein a third portion of the free end of the respective segment protrudes radially outward in relation to the jacket portion, wherein the second portions form a cover portion that can be pierced through in the axial direction and that closes the through-opening, wherein the third portions form a bearing portion of the stopper for bearing against a container edge of the container.

19 Claims, 3 Drawing Sheets

(58) Field of Classification Search
USPC ..... 215/358
See application file for complete search history.

(56) References Cited

U.S. PATENT DOCUMENTS

| | | | | |
|---|---|---|---|---|
| 1,051,242 | A * | 1/1913 | Lewis | B65D 39/12 215/358 |
| 2,637,462 | A * | 5/1953 | Becker | F16L 57/005 16/42 T |
| 3,338,447 | A * | 8/1967 | Meyers, Jr. | B65D 51/241 215/358 |
| 6,536,618 | B1 * | 3/2003 | Hwang | B65D 39/12 215/361 |
| 2004/0026353 | A1 | 2/2004 | Collins | |
| 2004/0112856 | A1 * | 6/2004 | Hwang | B65D 39/12 215/361 |
| 2008/0116165 | A1 * | 5/2008 | Lin | B65D 39/12 215/294 |
| 2015/0239620 | A1 * | 8/2015 | Elder | B65D 39/04 215/364 |
| 2016/0355302 | A1 * | 12/2016 | Hatamian | B65D 39/12 |
| 2019/0002164 | A1 | 1/2019 | Nakatani et al. | |

FOREIGN PATENT DOCUMENTS

| | | | |
|---|---|---|---|
| FR | 892608 | A | 5/1944 |
| GB | 2026995 | A | 2/1980 |
| WO | 0194019 | A1 | 12/2001 |

OTHER PUBLICATIONS

European Patent Office, Written Opinion of the European Search Report (English Language Translation), dated Apr. 23, 2020 (dated Apr. 23, 2020), 3 pages, European Patent Office, München, Germany (DE).

* cited by examiner

STOPPER FOR A CONTAINER

FIELD OF THE INVENTION

The present invention relates to a stopper for a container, in particular a stopper for containers that are used in the analytical and diagnostic field. The container can be in particular a bottle or a cuvette.

BACKGROUND OF THE INVENTION AND RELATED ART

For the purpose of analyzing a substance, in particular a liquid, for example blood, it is necessary that the substance to be analyzed is removed from the container or that further substances are introduced into the container. Depending on the analysis that is to be performed, it is possible that only a partial quantity of the substance stored in the container is removed and supplied for analysis or to the analysis apparatus. It may also be the case that, for analysis purposes, substance is removed several times from the container or substances are introduced several times into the container. Generally, the substance that is to be analyzed is removed from the container by means of a pipetting device or a syringe or further substances are introduced into the container. The procedure of removing the substance from the container can take place in a fully automated manner, for example by means of an automatic pipetting apparatus. As regards the substance to be analyzed, and in particular with respect to repeated removal of substance from the container or repeated introduction of substance into the container, it is necessary to avoid evaporation of the substance located in the container and to avoid admission of foreign bodies into the container and thus into the substance that is to be analyzed. It is therefore necessary to close or at least partially cover the opening of the container, but at the same time to permit simple removal of the substance from the container.

For this purpose, it is known to cover the container with a thin membrane, said membrane being slit so that it can be easily pierced through by the removal device, for example a pipet tip or hollow needle. The production of such covers generally requires subsequent slitting of the membrane, which necessitates an additional operating step or correspondingly complicated tooling. A membrane of this kind can be, for example, a constituent part of a screw-on lid that is screwed onto the container. However, handling and production are complicated, since different materials generally have to be used for the membrane and for the rest of the lid. Moreover, the membrane has to be slit in an additional operating step and connected to the lid.

EP 0 097 591 A1 discloses a stopper for a container, said stopper having a cover portion that can be pierced through by means of a pipet tip for the purpose of introducing substance into the container or removing substance from the container. At a front end in the direction of insertion of the stopper, i.e. at the end directed toward the interior of the container, the cover portion has a plurality of slits, as a result of which segments are formed. The segments bear on one another in a basic state and form a closed cover portion. The slits allow the cover portion to be pierced through axially by means of the pipet tip, with the segments being deformed radially outward for this purpose. The segments are pretensioned in such a way that, after the pipet tip has been pulled out of the cover portion, the segments return to their basic state and thus again close the container opening. A disadvantage of the stopper known from EP 0 097 591 A1 is that, during the insertion of the stopper, an undesired deformation of the segments can occur as a consequence of the stopper interacting with a container wall. Moreover, production of the stopper is difficult on account of the slits that have to be made. Moreover, when force is exerted on the cover portion, there is the danger of changing the position of the stopper in the container.

Object of the Invention

The object of the present invention is to make available a stopper for a container, which stopper reliably prevents evaporation of substance from a container or entry of foreign bodies into the container, but nonetheless permits simple introduction of substance into the container or removal of substance from the container. In addition, the stopper is intended to be particularly easy to produce, in particular by means of injection molding. The stopper is intended in particular to be able to be produced without the need for subsequent formation of slits.

SUMMARY OF THE INVENTION

The stopper according to the invention has a jacket portion insertable into the container, wherein the jacket portion has a through-opening formed in an axial direction. The stopper has at least two segments, wherein the respective segment has a free end. A first portion of the free end of the respective segment forms a subregion of the jacket portion, and a second portion of the free end of the respective segment protrudes radially inward in relation to the jacket portion. A third portion of the free end of the respective segment protrudes radially outward in relation to the jacket portion. The second portions form a cover portion that can be pierced through in the axial direction and that closes the through-opening, and the third portions form a bearing portion of the stopper.

By virtue of the fact that the respective segment has a free end, the segments are deformable or movable independently of one another in the region of the free ends. In particular, the second portions of the free end of the respective segment are deformable independently of the second portions of the free ends of the other segments, as a result of which the cover portion can be pierced through axially, for example by means of a pipet tip or a needle or other removal element/introduction element.

By virtue of the fact that the third portions protrude radially outward in relation to the jacket portion and form a bearing portion of the stopper, the stopper can be positioned relative to the container in a simple way since, during the insertion of the stopper into the container, the bearing portion forms a stop which, during the insertion of the stopper into the container, comes to bear axially on a container edge enclosing a container opening and to this extent prevents further insertion of the stopper into the container or limits the depth of insertion. The bearing portion is also advantageous as regards the piercing through of the cover portion by means of an external device, for example a pipet tip, since an axial force has to be exerted on the cover portion during the piercing. The bearing portion prevents an undesired further insertion of the stopper into the container and thus ensures reliable piercing of the cover portion.

As regards the second portions, it is considered particularly advantageous if the second portions are deformable independently of the other portions of the respective segment.

It is considered advantageous if the second portions have a lesser material thickness than the third portions. This favors a deformation of the second portions relative to a deformation of the bearing portions, when an axial force is exerted on the cover portion.

It is considered advantageous if the cover portion is formed at a rear end of the jacket portion, as seen in the direction of insertion of the stopper. This prevents a situation where foreign bodies accumulate on the jacket portion in a region of the through-opening directed away from the interior of the container and pass into the interior of the container when the cover portion is pierced through.

The segments are preferably connected, at the end of the segments, to adjacent segments.

It is considered particularly advantageous if the segments are connected to each other in the region of an end of the jacket portion directed away from the bearing portion. The segments are thereby connected to each other in the region of a front end of the jacket portion, as seen in the direction of insertion of the stopper.

The region of the jacket portion in which the segments are connected to each other is preferably configured as a closed annular structure. This ensures a particularly high degree of stability of the connection of the segments and of the stopper as a whole. A closed annular structure is also considered advantageous with regard to ejection of the stopper from an injection molding tool.

The segments preferably have a web-like configuration.

In one embodiment, provision is made that the jacket portion has a region with a cross section that widens in the direction of the bearing portion, or the jacket portion has a cross section that widens in the direction of the bearing portion. It is considered particularly advantageous if the widening is conical. On account of the widening cross section, a radially inward deformation of the free end of the respective segment is facilitated during the insertion of the stopper into the container. On account of the radially inward deformation, particularly good sealing of the container opening is achieved and, moreover, a force fit between the stopper and a container wall is brought about, as a result of which the stopper is held particularly securely in the container.

The cover portion and/or the bearing portion are/is preferably configured at the end of the jacket portion.

It is considered particularly advantageous if the cover portion and the bearing portion are configured in the same plane.

The cover portion and/or the bearing portion are/is preferably configured perpendicularly with respect to the axial direction.

In another embodiment, the cover portion and/or the bearing portion are/is formed at a rear end of the jacket portion, as seen in the direction of insertion of the stopper.

It is considered advantageous if a ratio of an axial extent of the first portion of the segments to an axial extent of the jacket portion is at least 80 percent. With such a length ratio, it is possible, with relatively low bending forces in the connection region between the segment and the rest of the jacket portion, to achieve quite a considerable radially inward displacement of the end of the segment directed away from the connection region. This has an advantageous effect on the segments deforming without being destroyed.

It is considered particularly advantageous if the free ends of adjacent segments are spaced apart from one another in a basic state of the stopper. The basic state is understood here as a state of the stopper when free of external forces.

In another embodiment, provision is made that a minimum distance between adjacent segments is at least 0.8 mm, in particular at least 1.0 mm. These distances are advantageous for production of the stopper by injection molding.

The stopper is preferably configured with radial symmetry.

In a particularly advantageous embodiment, provision is made that the respective segment is configured as a subregion of a rotation body, wherein a rotation axis assignable to the rotation body of the respective segment runs outside an axis of symmetry of the stopper. Preferably, the respective rotation axis runs outside of and parallel to the axis of symmetry of the stopper. This embodiment has the advantage that, during a radially inward deformation of the segments, subregions of the segments, particularly the second and third regions of the segments, form a closed, rotationally symmetrical body, as a result of which a particularly good sealing effect is achieved.

In another embodiment, the stopper has at least three segments, preferably at least four segments, in particular at least six segments. The force that has to be applied in order to pierce through the cover portion can be easily adapted by way of the number of segments. The greater the number of segments the stopper has, the less the force that has to be applied.

It is considered particularly advantageous if the segments are deformed radially inward, preferably elastically, during the insertion of the stopper into the container.

In another embodiment, provision is made that the second portions form a closed surface upon radially inward deformation of the segments.

It is considered particularly advantageous if the stopper is integrally formed in one piece.

It is preferable for the segments, in particular the entire stopper, to be produced from an elastic material. For example, the elastic material can be a thermoplastic elastomer, for example polyethylene.

It is considered particularly advantageous if, in a plan view in the axial direction, the second portions form sectors of a circle. It is also considered advantageous if, in a plan view in the axial direction, the third portions form ring sectors of a ring.

In another embodiment, provision is made that, in a cross section of the jacket portion in the connection region of the segments, the respective segment forms an arc of a circle.

It is entirely conceivable to use the stopper in combination with a lid that can be connected to the container. For this purpose, the lid has an opening, for access to the cover portion, wherein the lid secures the stopper against being pulled out of the container.

BRIEF DESCRIPTION OF THE DRAWING FIGURES

In the accompanying drawing figures, the invention is described in more detail on the basis of various exemplary embodiments, but without being limited to the particular embodiments shown described and shown herein.

DESCRIPTION OF EXEMPLARY EMBODIMENTS OF THE INVENTION

Figure 1:
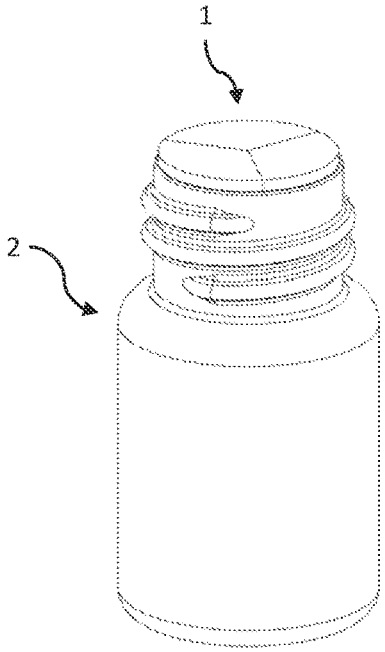
FIG. 1 is a perspective view showing an assembly of a container and a first embodiment of a stopper for a container according to the invention.

FIGS. 1 to 7 show a first embodiment of a stopper 1 according to the invention. The stopper 1 serves to close a container 2, which is shown here as a bottle. The container 2 has a bottle neck provided with a thread, wherein the stopper 1 is inserted into an opening of the bottle neck. The stopper 1 thus serves to close the opening of the container 2, in order to avoid evaporation of substances stored in the interior of the container 2 and moreover to avoid entry of foreign bodies into the interior of the container 2. By means of the features of the stopper 1 that are described below, the stopper 1 allows a suitable device, for example a pipet tip, to pierce through the stopper 1 in order to remove substances from the interior of the container 2 or to introduce substances into the interior of the container 2, the stopper 1 being designed in such a way that, after the force applied by the device has ended, the container opening is again closed by the stopper 1.

The stopper 1 has a jacket portion 3 insertable into the container 2, the jacket portion 3 having a through-opening 4 formed in an axial direction Z. The stopper 1 in the present embodiment has three segments 5, wherein the respective segment 5 has a free end. The segments 5 are connected to one another at their other end, in the present embodiment in the region of a front end of the jacket portion 3 in the direction of insertion of the stopper 1. The region in which the segments 5 are connected to one another is configured as a closed annular structure 12, as can be seen in particular from FIG. 6. The free end of the respective segment 5 has a first portion 6, a second portion 7 and a third portion 8. The first portion 6 of the free end of the respective segment 5 forms a subregion of the jacket portion 3. The second portion 7 protrudes radially inward in relation to the jacket portion 3, i.e. protrudes into the region of the through-opening 4, and the third portion 8 protrudes radially outward in relation to the jacket portion 3. The second portions 7 form a cover portion 9 of the stopper 1, wherein the cover portion 9 closes the through-opening 4 in the axial direction Z, as can be seen in particular from FIGS. 1 to 3. Since the second portions 7 are not connected directly to one another, as a result of the segmentation, and are therefore deformable independently of one another, the cover portion 9 can be pierced through in the axial direction Z, for example by means of a pipet tip. The third portions 8 of the segments 5 form a bearing portion 10 of the stopper 1, wherein the bearing portion 10 comes to bear in the axial direction Z on a container edge of the container 2 when the stopper 1 is inserted into the container 2, as a result of which the bearing portion 10 impedes further insertion of the stopper 1 into the container 2, as can be seen from FIG. 3. The bearing portion 10 of the stopper 1 is also advantageous as regards the piercing through of the cover portion 9, since the bearing portion 10 prevents a situation where the force exerted on the cover portion 9 for piercing through the latter presses the stopper 1 further into the container 2 instead of piercing the cover portion 9 and deforming the second portions 7.

Figure 3:
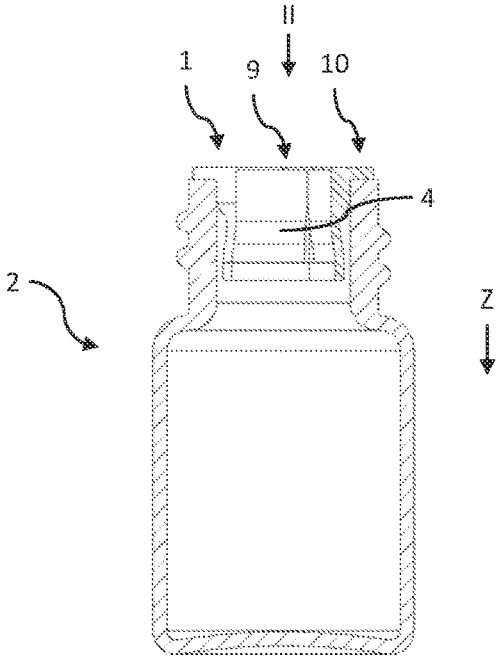
FIG. 3 is a sectional view showing the assembly of FIG. 1 taken along the line III-III in FIG. 2.
Figure 2:
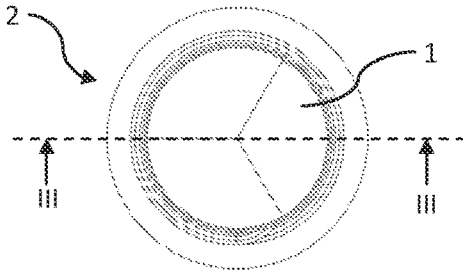
FIG. 2 is a plan view showing the assembly of FIG. 1 taken in the direction of the arrow II in FIG. 3.
Figure 4:
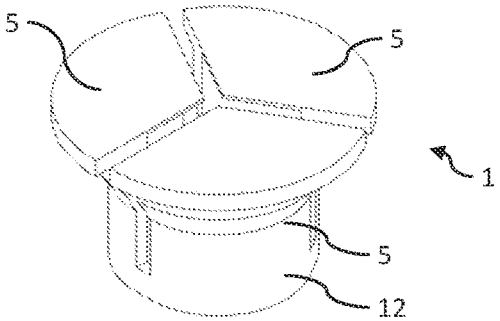
FIG. 4 is a perspective view showing the stopper of FIG. 1 in greater detail.

As can be seen in particular from FIG. 3, the second portions 7 have a lesser material thickness than the third portions 8. In this way, the stiffness or the force necessary for piercing through the cover portion 9 is advantageously reduced, but the stopper 1 still has a high degree of overall stability. The material thickness of the second portions 7 is also less than the material thickness of the first portions 6.

Figure 5:
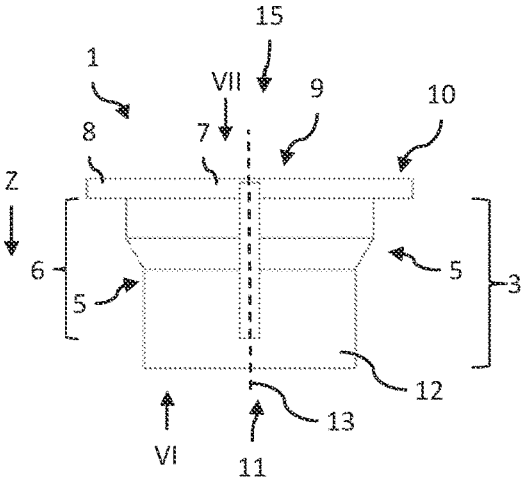
FIG. 5 is an elevation view showing the stopper of FIG. 4 taken in the direction of the arrow V in FIG. 6.

As can be seen in particular from FIG. 5, the jacket portion 3 has a region with a cross section that widens conically in the direction of the bearing portion 10. The widening cross section has the favorable effect that the segments 5 deform radially inward during the insertion of the stopper 1 into the container, as is shown in FIG. 3. To permit radially inward deformation of the segments 5, the free ends of adjacent segments are spaced apart from one another in an undeformed state of the stopper 1. FIGS. 4 to 7 show the stopper 1 in such undeformed state. In the undeformed state, the stopper 1 has three slits separating the segments 5 from one another and extending in the axial direction and radial direction, wherein the respective slits extend radially inward from the outside in the direction of a common center. Moreover, the slits extend from a rear end 15 of the stopper 1 in the direction of a front end 11 of the stopper 1, as far as the closed annular structure 12.

The cover portion 9 and the bearing portion 10 are configured in the same plane, wherein the cover portion 9 and the bearing portion 10 are formed, at the end of the jacket portion 3, on a rear end 15 of the stopper 1 as seen in the direction of insertion of the stopper 1.

The cover portion 9 and the bearing portion 10 are perpendicular to the axial direction Z. As can be seen in particular from FIGS. 1 to 3, the second portions 8 form a closed surface upon radially inward deformation of the segments 5, i.e. in the deformed state of the stopper 1 inserted into the container 2.

Figure 6:
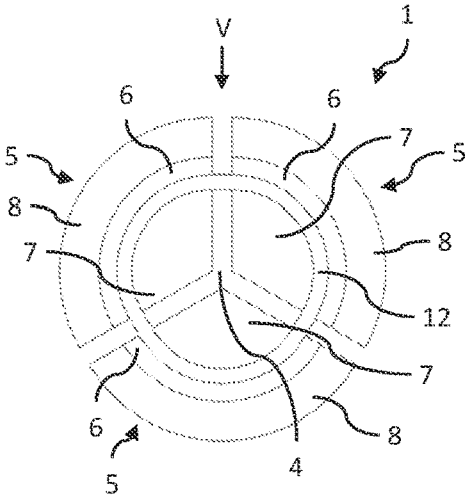
FIG. 6 is a plan view showing the stopper of FIG. 4 taken in the direction of the arrow VI in FIG. 5.
Figure 7:
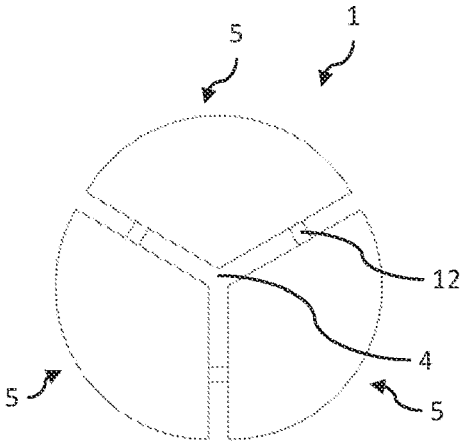
FIG. 7 is a plan view showing the stopper of FIG. 4 taken in the direction of the arrow VII in FIG. 5.
Figure 8:
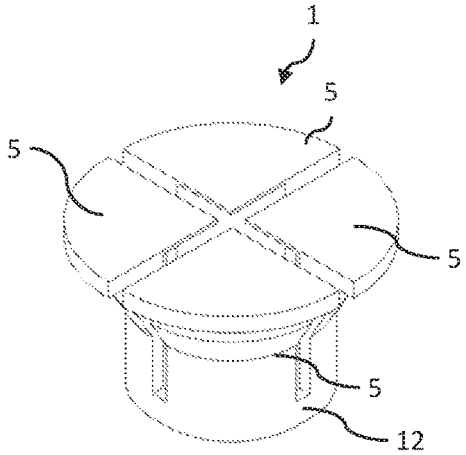
FIG. 8 is a perspective view showing a second embodiment of a stopper for a container according to the invention.
Figure 9:
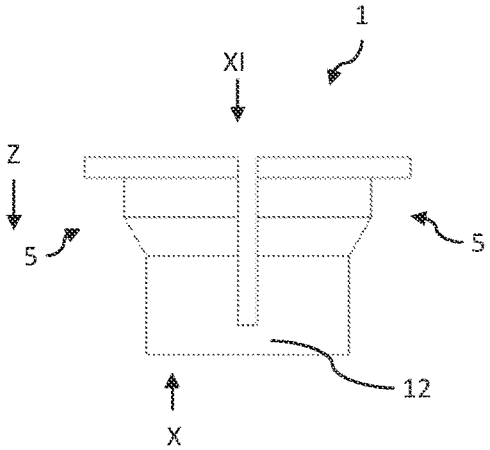
FIG. 9 is an elevation view showing the stopper of FIG. 8 taken in the direction of the arrow IX in FIG. 10.
Figure 10:
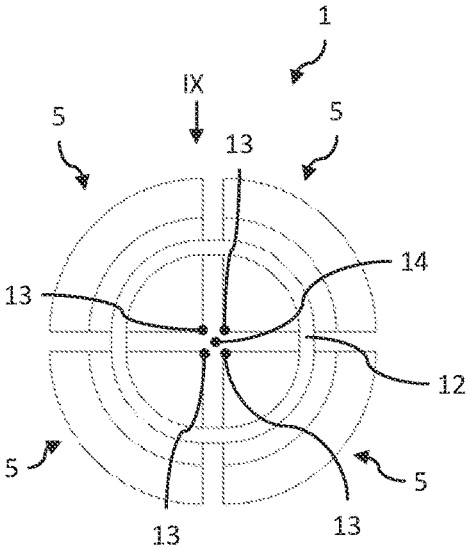
FIG. 10 is a plan view showing the stopper of FIG. 8 taken in the direction of the arrow X in FIG. 9.
Figure 11:
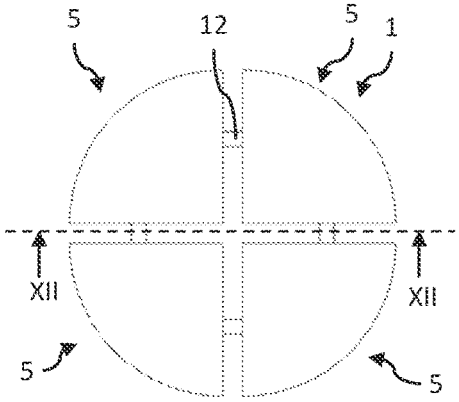
FIG. 11 is a plan view showing the stopper of FIG. 8 taken in the direction of the arrow XI in FIG. 9.
Figure 12:
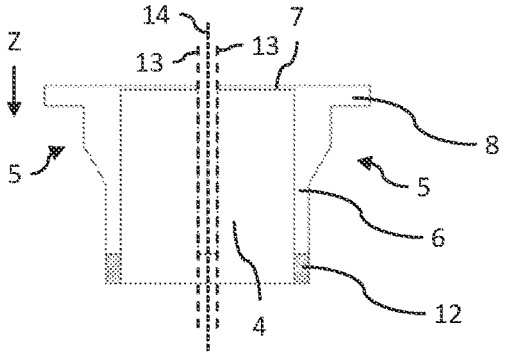
FIG. 12 is a sectional view showing the stopper of FIG. 8 taken along the line XII-XII in FIG. 11.
Figure 13:
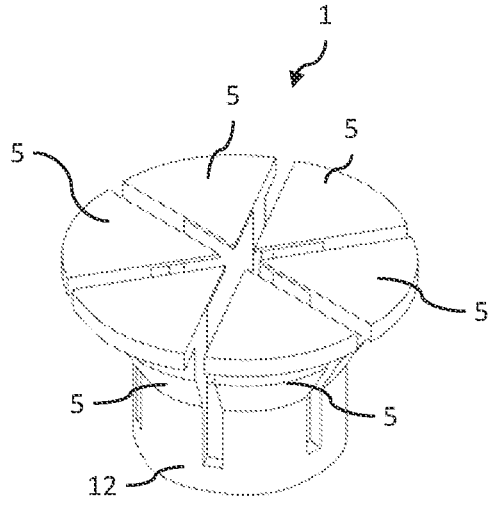
FIG. 13 is a perspective view showing a third embodiment of a stopper for a container according to the invention.
Figure 14:
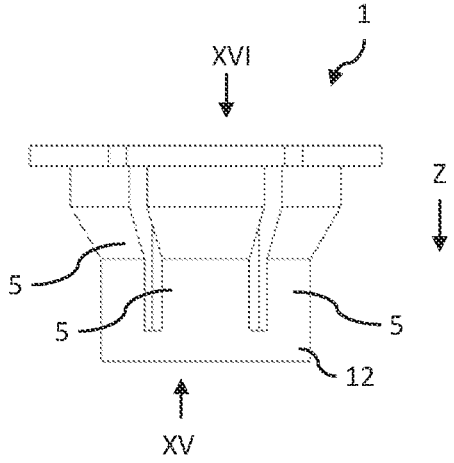
FIG. 14 is an elevation view showing the stopper of FIG. 13 taken in the direction of the arrow XIV in FIG. 15.
Figure 15:
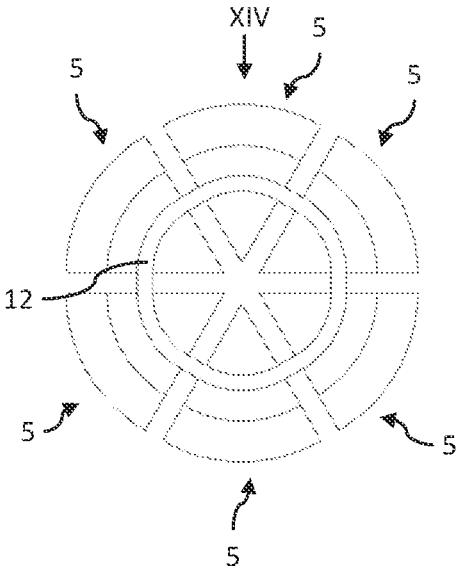
FIG. 15 is a plan view showing the stopper of FIG. 13 taken in the direction of the arrow XV in FIG. 14.
Figure 16:
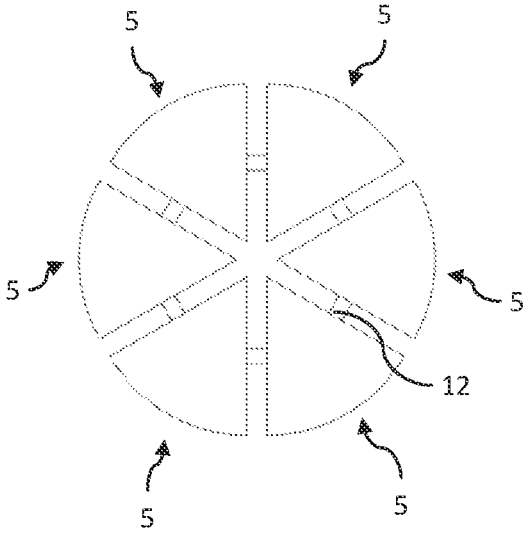
FIG. 16 is a plan view showing the stopper of FIG. 13 taken in the direction of the arrow XVI in FIG. 14.

As can be seen in particular from FIG. 6, the respective segment 5 is designed as a subregion of a rotation body, wherein a rotation axis 13 assignable to the rotation body of the respective segment runs outside an axis of symmetry 14 (see FIG. 10; FIG. 12) of the stopper 1 and parallel to the axis of symmetry 14. The stopper 1 is also designed radially symmetrically with respect to the axis of symmetry 14, wherein the order of symmetry corresponds to the number of the segments 5. The symmetry of the first embodiment of the stopper 1 is thus 3-fold. By virtue of the fact that the respective segment 5 is designed as a subregion of a rotation body and, moreover, that the stopper 1 is radially symmetrical, the segments 5 form a closed, rotationally symmetrical body, upon radially inward deformation of the segments 5, in a region directed away from the connection regions of the segments 5, which has an advantageous effect on the covering action and sealing action of the stopper 1.

In a plan view in the axial direction Z, the second portions 7 form sectors of a circle and the third portions 8 form ring sectors of a ring.

The second embodiment of the stopper 1 shown in FIGS. 8 to 12 and the third embodiment of the stopper 1 shown in FIGS. 13 to 16 differ from the first embodiment of the stopper 1 shown in FIGS. 1 to 7 in terms of the number of segments 5, the second embodiment having four segments 5 and the third embodiment having six segments 5.

That which is claimed is:

1. A stopper for a container, wherein the stopper has a jacket portion insertable into the container, wherein the jacket portion has a through-opening formed in an axial direction, wherein the stopper has a plurality of segments, wherein each respective segment has a free end, wherein a first portion of the free end of the respective segment forms a subregion of the jacket portion, a second portion of the free end of the respective segment protrudes radially inward in relation to the jacket portion, and a third portion of the free end of the respective segment protrudes radially outward in relation to the jacket portion, wherein the second portions form a cover portion that is configured to be pierced through in the axial direction and that closes the through-opening, and wherein the third portions form a bearing portion of the stopper for bearing against a container edge of the container during insertion of the jacket portion of the stopper into the container, and wherein the cover portion and the bearing portion are configured in the same plane.

2. The stopper as claimed in claim 1, wherein the second portions have a lesser material thickness than the third portions.

3. The stopper as claimed in claim 1, wherein the segments are connected to each other in a region of an end of the jacket portion directed away from the bearing portion.

4. The stopper as claimed in claim 3, wherein the region is configured as a closed annular structure.

5. The stopper as claimed in claim 1, wherein the jacket portion has a cross section that widens in the direction of the bearing portion.

6. The stopper as claimed in claim 1, wherein at least one of the cover portion and the bearing portion is configured at an end of the jacket portion.

7. The stopper as claimed in claim 1, wherein a ratio of an axial extent of the first portion of the segments to an axial extent of the jacket portion is at least 80%.

8. The stopper as claimed in claim 1, wherein the free ends of adjacent segments are spaced apart from each other in an undeformed state of the stopper.

9. The stopper as claimed in claim 8, wherein a minimum distance between adjacent segments is at least 0.8 mm.

10. The stopper as claimed in claim 1, wherein the respective segment is configured as a subregion of a rotation body, wherein a rotation axis of the rotation body of the respective segment runs outside an axis of symmetry of the stopper and parallel to the axis of symmetry of the stopper.

11. The stopper as claimed in claim 1, wherein the stopper has at least three segments.

12. The stopper as claimed in claim 1, wherein the segments are deformed radially inward elastically during the insertion of the jacket portion of the stopper into the container.

13. The stopper as claimed in claim 12, wherein the second portions form a closed surface upon radially inward deformation of the segments.

14. The stopper as claimed in claim 1, wherein the stopper is integrally formed in one piece.

15. A stopper for a container, wherein the stopper has a jacket portion insertable into the container, wherein the jacket portion has a through-opening formed in an axial direction, wherein the stopper has a plurality of segments, wherein each respective segment has a free end, wherein a first portion of the free end of the respective segment forms a subregion of the jacket portion, a second portion of the free end of the respective segment protrudes radially inward in relation to the jacket portion, and a third portion of the free end of the respective segment protrudes radially outward in relation to the jacket portion, wherein the second portions form a cover portion that is configured to be pierced through in the axial direction and that closes the through-opening, and wherein the third portions form a bearing portion of the stopper for bearing against a container edge of the container during insertion of the jacket portion of the stopper into the container, wherein the respective segment is configured as a subregion of a rotation body, and wherein a rotation axis of the rotation body of the respective segment runs outside an axis of symmetry of the stopper and parallel to the axis of symmetry of the stopper.

16. The stopper as claimed in claim 15, wherein the jacket portion has a cross section that widens in the direction of the bearing portion.

17. The stopper as claimed in claim 15, wherein the free ends of adjacent segments are spaced apart from each other in an undeformed state of the stopper.

18. The stopper as claimed in claim 15, wherein the segments are deformed radially inward elastically during the insertion of the jacket portion of the stopper into the container.

19. The stopper as claimed in claim 15, wherein the stopper is integrally formed in one piece.

* * * * *